United States Patent [19]

Widmer et al.

[11] Patent Number: 4,845,945

[45] Date of Patent: Jul. 11, 1989

[54] EXHAUST ELBOW TROUGH

[75] Inventors: Steven L. Widmer; Robin J. Schrage, both of Oshkosh; Jeffery L. White, Fond du Lac; John H. Gundert, Malone, all of Wis.

[73] Assignee: Brunswick Corporation, Skokie, Ill.

[21] Appl. No.: 256,498

[22] Filed: Oct. 12, 1988

[51] Int. Cl.[4] ..... F01N 3/04

[52] U.S. Cl. ..... 60/310; 440/89

[58] Field of Search ..... 60/310; 440/89

[56] References Cited

U.S. PATENT DOCUMENTS 3,541,786 11/1970 Sarra .

4,573,318 3/1986 Entringer et al. .

*Primary Examiner*—Douglas Hart

*Attorney, Agent, or Firm*—Andrus, Sceales, Starke & Sawall

[57] ABSTRACT

A water jacketed exhaust elbow (10) for a marine propulsion system includes an intake exhaust passage (22) communicating with a discharge exhaust passage (26), a water jacket (27) around the exhaust passages, and a trough member (200) extending longitudinally along a water channel (44) along the exterior of the discharge exhaust passage (26) to guide water therealong to mix with exhaust at the end (42) of the discharge exhaust passage (26). The trough member (200) extends beyond the end tip (42) of the discharge exhaust passage (26) and has a sharp edge (202) providing a clean parting surface for the coolant water and preventing ingestion of water back into the discharge exhaust passage (26).

5 Claims, 1 Drawing Sheet

EXHAUST ELBOW TROUGH

BACKGROUND AND SUMMARY

The invention relates to marine propulsion systems having an exhaust elbow extending from the engine and discharging engine coolant water into the engine combustion product exhaust.

Exhaust elbows for marine propulsion systems are known, for example as shown in U.S. Pat. Nos. 3,541,786 and 4,573,318, incorporated herein by reference. The elbow extends from the engine manifold and has separate intake passages for exhaust and water. The elbow discharges mixed exhaust and water.

Wate ingestion is a significant problem in exhaust elbows for marine propulsion systems. Engine pulsations due to reciprocating piston movement tends to suck any water within or at the outer tip of the elbow back into the engine, which is undesirable. Water can tend to collect at the discharge end tip of the elbow where coolant water is discharged into the exhaust to mix therewith. Water or moisture deposited or formed at this outer tip end actually travels backwards into the interior of the exhaust passage within the elbow in a pulsating manner and eventually back into the engine. This pulsating ingestion becomes more pronounced with increasing engine size.

The present invention addresses and solves the above noted problems, and provides further improvements beyond those shown in above incorporated U.S. Pat. No. 4,573,318. The present invention provides a trough member which extends the length of the water travel channel along the exhaust elbow and provides a clean sharp parting surface for the water.

DESCRIPTION OF PRIOR ART

Figure 1:
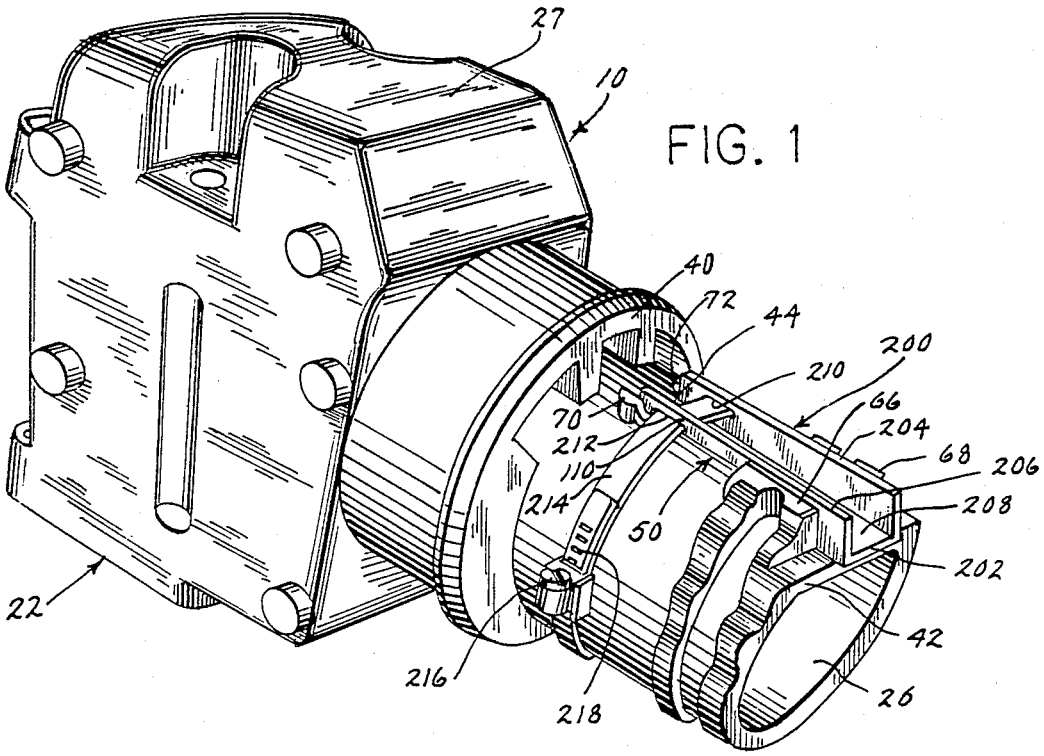
FIG. 1 is a perspective view of an exhaust elbow with a trough member in accordance with the invention.
Figure 2:
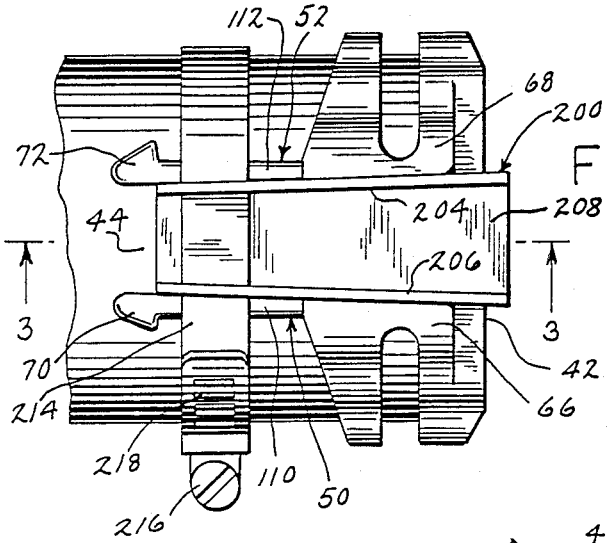
FIG. 2 is a top view of a portion of the structure of FIG. 1.
Figure 3:
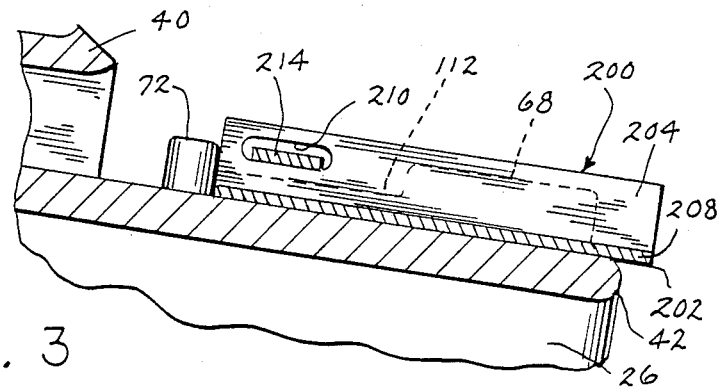
FIG. 3 is a sectional view taken along line 3—3 of FIG. 2.

FIG. 1 shows the exhaust elbow of above incorporated U.S. Pat. No. 4,573,318, and uses like reference numerals from the '318 patent to facilitate clarity. FIG. 1 shows a water jacketed exhaust elbow 10 for a marine propulsion system, for example as shown in FIG. 1 of the '318 patent. The elbow includes an intake exhaust passage 22 communicating with a discharge exhaust passage 26, for example as shown in FIG. 3 of the '318 patent. An outer water jacket 27 is around the exhaust passages. As shown in FIG. 3 of the '318 patent, coolant water flows from the engine upwardly around the intake exhaust passage 22 and then bends around and exits the water jacket at end 40 upstream of discharge end tip 42 of discharge exhaust passage 26. As shown in FIG. 1 of the '318 patent, a bellows exhaust tube is connecred around the end 40 of the water jacket and extends externally downstream from the water jacket around discharge exhaust passage 26 for discharging the water and exhaust through the transom of the boat or through the lower gearcase.

A central channel 44 extends longitudinally along the exterior of discharge exhaust passage 26 to guide water therealong from the water jacket at end 40 to the end 42 of the discharge exhaust passage to mix with exhaust thereat. The mixed combustion product exhaust and coolant water is then discharged through the exhaust tube, as shown in FIG. 1 of the '318 patent. Channel 44 is formed by a pair of sidewalls 50 and 52 extending longitudinally along the exterior of passage 26. Sidewall 50 has a downstream end portion 66 having a greater height than upstream portion 70, and has a central portion 110 having a lesser height than portion 70. Sidewall 52 has a downstream end 68 having a greater height than upstream portion 72, and a central portion 112 having a lesser height than portion 72, all as in the '318 patent, to which further reference may be had.

DESCRIPTION OF PRESENT INVENTION

In accordance with the present invention, a trough member 200 extends longitudinally in central channel 44 along the exterior of discharge exhaust passage 26 to guide water therealong to mix with exhaust at the end 42 of discharge exhaust passage 26. Trough member 200 provides a clean sharp parting surface for the water at the end 202 of the trough member and prevents ingestion of water back into discharge exhaust passage 26.

Discharge exhaust elbow 10 is typically a cast metal member, for example formed by a lost foam casting process, and hence discharge exhaust end 42 has a given thickness and is typically somewhat rounded, and hence in turn is subject to water creeping therearound. Trough member 200 is a stamped metal member which has a clean sharp cut end at 202, thus providing a clean sharp parting surface for the water.

Trough member 200 is a U-shaped member having a pair of sidewalls 204 and 206 and a bottom wall 208 extending beyond the end tip 42 of the discharge exhaust passage and providing the noted sharp edge at the ends of the walls to provide a clean parting surface. Each sidewall 204, 206 has an aperture 210, 212, respectively, therethrough. A clamping band 214 extends around discharge exhaust passage 26 and through apertures 210 and 212 to clamp trough member 200 to the discharge exhaust passage. Clamping band 214 itself is known in the art, and is tightened by screw member 216 threadingly engaging spaced apertures 218 in the band.

Sidewalls 204 and 206 of trough member 200 taper laterally away from each other as they extend rearwardly toward and beyond discharge exhaust end tip 42. This taper creates an outward draw along central channel 44 to enhance water flow therealong, and minimize breakup of such water flow. Bottom wall 208 of trough member 200 extends continuously along central channel 44 and beyond end tip 42 and provides the noted sharp edge at end 202 to provide the noted clean parting surface.

Apertures 210 and 212 in the sidewalls of the trough member are rearward of and at about the same height as respective portions 72 and 70 of central channel sidewalls 52 and 50. Clamping band 214 extends across central channel 44 rearwardly of and at about the height of portions 72 and 70 of the central channel sidewalls. Clamping band 214 extends over sidewall portions 110 and 112 of central channel 44. Sidewalls 204 and 206 of trough member 200 have a greater height than sidewall portions 68 and 66 of the central channel, which are the greatest height portions of the central channel sidewalls.

It is recognized that various equivalents, alternatives and modifications are possible within the scope of the appended claims.

What is claimed:

1. A water jacketed exhaust elbow for a marine propulsion system, comprising:

an intake exhaust passage communicating with a discharge exhaust passage;

water jacket means around said exhaust passages;

a trough member extending longitudinally along the exterior of said discharge exhaust passage to guide water therealong to mix with exhaust at the end of said discharge exhaust passage, said trough member providing a clean parting surface for said water and preventing ingestion of water back into said discharge exhaust passage, wherein said trough member has a pair of sidewalls and a bottom wall extending beyond the end tip of said discharge exhaust passage and providing a sharp edge at the ends of said walls to provide said clean parting surface.

2. A water jacketed exhaust elbow for a marine propulsion system, comprising:

an intake exhaust passage communicating with a discharge exhaust passage;

water jacket means around said exhaust passages;

a trough member extending longitudinally along the exterior of said discharge exhaust passage to guide water therealong to mix with exhaust at the end of said discharge exhaust passage, said trough member providing a clean parting surface for said water and preventing ingestion of water back into said discharge exhaust passage, wherein said trough member is a U-shaped member having a pair of sidewalls and a bottom wall, each of said sidewalls having an aperture therethrough, and comprising a clamping band extending around said discharge exhaust passage and through said apertures in said sidewalls of said U-shaped trough member to clamp the latter to said discharge exhaust passage.

3. A water jacketed exhaust elbow for a marine propulsion system, comprising:

an intake exhaust passage communicating with a discharge exhaust passage;

water jacket means around said exhaust passages;

a central channel extending longitudinally along the exterior of said discharge exhaust passage and having sidewall sections formed by first, second and third portions, said second portions being between said first and third portions and having a lesser height than said first and third portions;

a trough member extending longitudinally in said central channel between said sidewall sections and providing a sharp clean parting surface preventing ingestion of water back into said discharge exhaust passage, said trough member having a pair of sidewalls extending along said sidewall sections of said central channel, each said sidewall of said trough member having an aperture therethrough above said second portion of the respective said sidewall section of said central channel and rearwardly of and at about the same height as the respective said first portion of the respective said sidewall section of said central channel;

a clamping band extending around said discharge exhaust passage and through said apertures in said sidewalls of said trough member to clamp the latter to said discharge exhaust passage, said clamping band extending across said central channel rearwardly of and at about the height of said first portions of said sidewall sections of said central channel.

4. The invention according to claim 3 wherein said trough member has a bottom wall extending between said sidewalls, and wherein said bottom wall and said sidewalls extend continuously along said central channel and beyond the end tip of said discharge exhaust passage and provide a sharp edge at the ends of said bottom wall and said sidewalls to provide said clean parting surface.

5. The invention according to claim 4 wherein said first portions of said sidewall sections of said central channel have a lesser height than said third portions of said sidewall sections of said central channel, and wherein said sidewalls of said trough member have a greater height than said third portions of said sidewall sections of said central channel.

* * * * *